US006221270B1

(12) United States Patent
Saito et al.

(10) Patent No.: US 6,221,270 B1
(45) Date of Patent: Apr. 24, 2001

(54) PROCESS FOR PRODUCING COMPOUND FOR RARE EARTH METAL RESIN-BONDED MAGNET

(75) Inventors: Katsuyoshi Saito; Yasunari Kaneko, both of Kusatsu; Naoyuki Ishigaki, Osaka; Shin Mishima, Osaka; Shinji Otsuki, Osaka; Yoshihiko Nishino, Osaka, all of (JP)

(73) Assignee: Sumitomo Special Metal Co., Ltd., Osaka (JP)

( * ) Notice: Subject to any disclaimer, the term of this patent is extended or adjusted under 35 U.S.C. 154(b) by 0 days.

(21) Appl. No.: 09/335,829

(22) Filed: Jun. 18, 1999

(30) Foreign Application Priority Data

Jun. 22, 1998 (JP) ..... 10-174954
Oct. 10, 1998 (JP) ..... 10-226022

(51) Int. Cl.[7] ..... B22F 1/00

(52) U.S. Cl. ..... 252/62.55; 252/62.54; 264/612; 148/105; 148/100; 148/104; 23/313 R

(58) Field of Search ..... 252/62.55, 62.54; 264/612; 148/105, 100, 104; 23/313 R

(56) References Cited

FOREIGN PATENT DOCUMENTS

778594 * 6/1997 (EP) .
8-183665 7/1996 (JP) .
8-301610 11/1996 (JP) .

* cited by examiner

*Primary Examiner*—C. Melissa Koslow
(74) *Attorney, Agent, or Firm*—Knobbe, Martens, Olson & Bear, LLP

(57) ABSTRACT

A process for producing a compound for a rare earth metal resin-bonded magnet includes: a slurry preparation step of mixing materials containing a magnetic alloy powder of a rare earth metal alloy, a resin binder, and an organic solvent into a slurry; and a drying step of spraying and drying the slurry by means of a spray dryer apparatus to produce the compound containing the magnetic alloy powder of the rare earth metal alloy and the resin binder.

10 Claims, 3 Drawing Sheets

PROCESS FOR PRODUCING COMPOUND FOR RARE EARTH METAL RESIN-BONDED MAGNET

BACKGROUND OF THE INVENTION

1. Field of the Invention

The present invention relates to a process for producing a compound for rare earth metal resin-bonded magnet in powdery granular form for use as a resin-bonded magnet molded into a predetermined shape by mixing a ferromagnetic alloy powder containing a rare earth element such as R—Fe—B alloy, R—Co alloy, R—Fe—N alloy (where R represents a rare earth element such as Sm or Nd), together with a resin component as a binder.

2. Description of the Related Art

A permanent magnet molded into a predetermined shape is essential as a component of a motor or an actuator to be used in household electric appliances, automobiles, computers, and their peripheries. The scale reduction, energy saving, and weight reduction of these final products are always required, and also motors and actuators are required to have less dimension, less weight, and higher efficiency. In accordance with these needs, a smaller and stronger molded product of a permanent magnetic material is demanded as a component of a motor or an actuator.

Generally, such molded product of a permanent magnetic material can be classified into two kinds: a sintered magnet and a resin-bonded magnet. A sintered magnet is produced by molding a fine powder of a magnetic alloy into a predetermined shape with a high-molecule resin used as a binder, and heating the molded product to remove or burn the binder, followed by sintering. Therefore, the obtained magnet almost consists of a permanent magnetic alloy component alone, and is excellent in magnetic properties, so that it is preferable. However, this requires both the step of molding the magnetic powder and the sintering step. Further, the sintering step requires a comparatively long time, and moreover the production yield is low due to great shrinkage in the sintering step.

On the other hand, a resin-bonded magnet is obtained by using a resin, preferably a reaction-curing resin, as a binder and molding a ferromagnetic alloy powder and the resin into a predetermined shape. In the resin-bonded magnet, the relative ratio of the ferromagnetic alloy decreases due to the presence of the binder. As a result, the resin-bonded magnet is inferior to the sintered magnet in magnetic intensity. However, the resin-bonded magnet has characteristics such that the dimension change is small in the steps after the molding, resulting in a high yield, and it can conform to a variety of product shapes simply by selecting a suitable shape of the mold, thereby achieving an excellent freedom in the shape of the product to be obtained.

A resin-bonded magnet is completed by mixing and covering a ferromagnetic alloy powder with a resin, preferably a reactive resin material into a powdery granular compound for molding, compression-molding the compound in a mold having a predetermined shape, and preferably heating the molded product to reaction-cure the reaction-curing resin material. Conventionally, such a compound has been produced by the following steps.

(1) A ferromagnetic alloy powder of a rare earth metal alloy is ground to have a particle size of less than 250 $\mu$m, typically 30 to 250 $\mu$m. Then, a reaction-curing resin material and a solvent are added and the mixture is kneaded by means of a kneading apparatus such as a kneader.

(2) The obtained kneaded product composed of the magnetic powder and the reaction-curing resin sometimes contains a large agglomerate and is not suitable for molding as it is. Therefore, the kneaded product is ground and the particles are regulated.

(3) The ground kneaded product is then dried to remove the solvent.

(4) The kneaded product after drying, i.e. a compound, is sieved for classification to collect a compound of less than 250 $\mu$m composed of the magnetic powder and the reaction-curing resin.

(5) A lubricant is added and mixed with the compound to complete compound granules for compression molding.

However, the above conventional process involves the following problems.

a) A kneading apparatus such as a kneader having a large shear force is used in preparing the compound. Therefore, the powdery particles of the material alloy is further ground to generate a fine powder, causing change in the particle size distribution of the ferromagnetic alloy powder. As a result, the particle size distribution of the compound granules also changes, leading to decrease in the compression molding property.

b) A rare earth metal alloy, particularly an Nd alloy, especially the fine powder of the above exemplary magnetic alloy, is extremely liable to be oxidized, and the generated oxide decreases the magnetic properties of the resin-bonded magnet after molding.

c) The conventional process requires a long time of 20 to 25 hours for a step of preparing the compound, and moreover it involves a batch process, so that the production efficiency is poor and the cost is high.

The purpose of the present invention is to provide a process for producing a compound that solves the above-mentioned problem of the prior art. Namely, the present invention aims at continuously producing compound granules for a rare earth metal resin-bonded magnet in a short time in which little amount of fine powder is generated due to grinding of the material alloy in preparing the compound, resulting in excellent magnetic properties of the resin-bonded magnet.

SUMMARY OF THE INVENTION

The present invention provides a process for producing a compound for a rare earth metal resin-bonded magnet, comprising: a slurry preparation step of mixing materials containing a magnetic alloy powder of a rare earth metal alloy, a resin binder, and an organic solvent into a slurry; and a drying step of spraying and instantly drying said slurry by means of a spray dryer apparatus to produce the compound.

The ferromagnetic alloy powder to be used in the rare earth metal resin-bonded magnet has a particle size of 30 to 250 $\mu$m, which is larger than the particle size of a magnetic alloy powder to be used in a sintered magnet, i.e. 1 to 10 $\mu$m. Therefore, even if the magnetic alloy powder is mixed with a resin component into a slurry, it deposits rapidly because its density is high. For this reason, it was considered almost impossible to produce a compound by such a process. The inventors of the present invention have found out that the purpose of the present invention can be achieved by supplying a slurry to a spray dryer in a short time after preparation of the slurry, thereby completing the present invention.

The preparation of the slurry does not need a kneading apparatus such as a kneader having a high shear force, further grinding of the particles of the magnetic alloy powder does not occur, thereby preventing generation of a fine particle magnetic alloy which is liable to be oxidized. In addition, the compound is completed in a short time.

The continuous production of the compound can be carried out by continuously supplying the materials to a slurry preparation apparatus and mixing them to continuously prepare a slurry, and then supplying the slurry to a spray dryer. Alternatively, two slurry preparation apparatus may be provided in which a slurry prepared in one preparation apparatus is supplied to a spray dryer while the materials are being measured and mixed in the other slurry preparation apparatus to prepare a slurry, whereby the slurry is continuously supplied to a spray dryer by switching the supplying passageway.

The organic solvent suitable for spray drying has, unlike water, a low concentration of dissolved oxygen and is effective in preventing deterioration of the magnetic alloy powder by oxidation. Also, by applying a supersonic wave to the organic solvent, it is possible to degas the organic solvent to remove the dissolved air and water, the concentration of the dissolved oxygen can be reduced easily before supplying the organic solvent for preparation of the slurry.

The above resin binder is preferably a reaction-curing resin because it increases the strength of the molded product.

In the present invention, the slurry preferably has a magnetic alloy powder concentration of 15 to 50 vol % (58 to 90 wt %).

If the magnetic alloy powder concentration is less than 15 vol % (58 wt %), the viscosity of the slurry lowers to increase the speed of deposition of the magnetic alloy powder, so that as a result the magnetic alloy powder deposits and accumulates in the pipe from the slurry preparation apparatus to the spray dryer, making it impossible to transport the slurry at a uniform slurry concentration. Conversely, if the magnetic alloy powder concentration exceeds 50 vol % (90 wt %), the fluidity of the slurry decreases because the concentration is too high. This also makes it difficult to transport the slurry at a uniform concentration through a fixed-rate supplying pump or a slurry supplying pipe.

The ratio of the binder resin material to the magnetic alloy powder is preferably about 100/1 to 20/1 in terms of the magnetic alloy powder/resin material weight ratio. If the ratio of the magnetic alloy powder exceeds 100/1 to be too high, the ratio of the binder resin becomes too low, whereby the mechanical strength of the resin-bonded magnet decreases. On the other hand, if the binder exceeds 20/1 to be too much, the magnetic properties of the molded resin-bonded magnet decrease, providing a permanent magnet that is practically insufficient.

Said organic solvent to be used in the present invention preferably contains a good solvent and a poor solvent of said resin, preferably said reaction-curing resin. Particularly, it is preferable that said good solvent is one or more kinds of ketone solvents, and said poor solvent is one or more kinds of aromatic hydrocarbons or alicyclic hydrocarbons.

Such an organic solvent composition improves the fluidity of a slurry to give a compound more suitable for press molding, and also use of the compound provides a press-molded product with improved mechanical strength. Here, the term "poor solvent" is used in a meaning that includes not only a solvent that does not dissolve the resin at all but also a solvent having a little solubility of the resin.

The composition of said organic solvent is preferably within the range of 70/30 to 10/90 in terms of the good solvent/poor solvent weight ratio. If the good solvent is too much, a resin powder is generated in a large amount at the time of drying. If the poor solvent is too much, the resin does not dissolve effectively.

A hot air for drying the slurry is required to be sufficiently hot for carrying out speedy drying, and to be not too high to decompose the resin binder or to cause a curing reaction of a reaction-curing resin material when a reaction-curing resin is used as the resin. The temperature of the hot air is preferably set within the range of 60 to 140° C., since organic solvents that evaporate comparatively mildly at room temperature have a boiling point of 60° C. or more, and the temperature at which reaction-curing resin materials cure rapidly is above 150° C.

The present invention also provides an apparatus for producing a compound for a rare earth metal resin-bonded magnet, comprising: at least one slurry preparation apparatus for mixing materials containing at least a magnetic alloy powder of a rare earth metal alloy, a resin binder, and an organic solvent into a slurry; and a spray dryer disposed below said slurry preparation apparatus for atomizing and drying said slurry into a compound for a rare earth metal resin-bonded magnet; and a transport apparatus for transporting said slurry to said spray dryer, wherein said transport apparatus comprises a slurry supplying pipe and a pump, and said slurry supplying pipe does not have a portion with an inclination angle of less than 45°.

In the production apparatus to be used in the present invention, it is especially necessary to prevent agglomeration and deposition of the magnetic alloy powder in the slurry. The slurry can be supplied to the spray dryer in an uniform state by disposing the slurry preparation apparatus above the spray dryer and by providing a structure such that the slurry supplying pipe does not have a portion with an inclination angle of less than 45°. The larger the inclination angle of the slurry supplying pipe is, the more preferable it is. The inclination angle of the slurry supplying pipe is more preferably larger than 60°, and most preferably vertical or nearly vertical.

BRIEF DESCRIPTION OF THE DRAWINGS

The above and further objects and features of the invention will more fully be apparent from the following detailed description with accompanying drawings, in which.

DETAILED DESCRIPTION OF THE PREFERRED EMBODIMENTS

Figure 1:
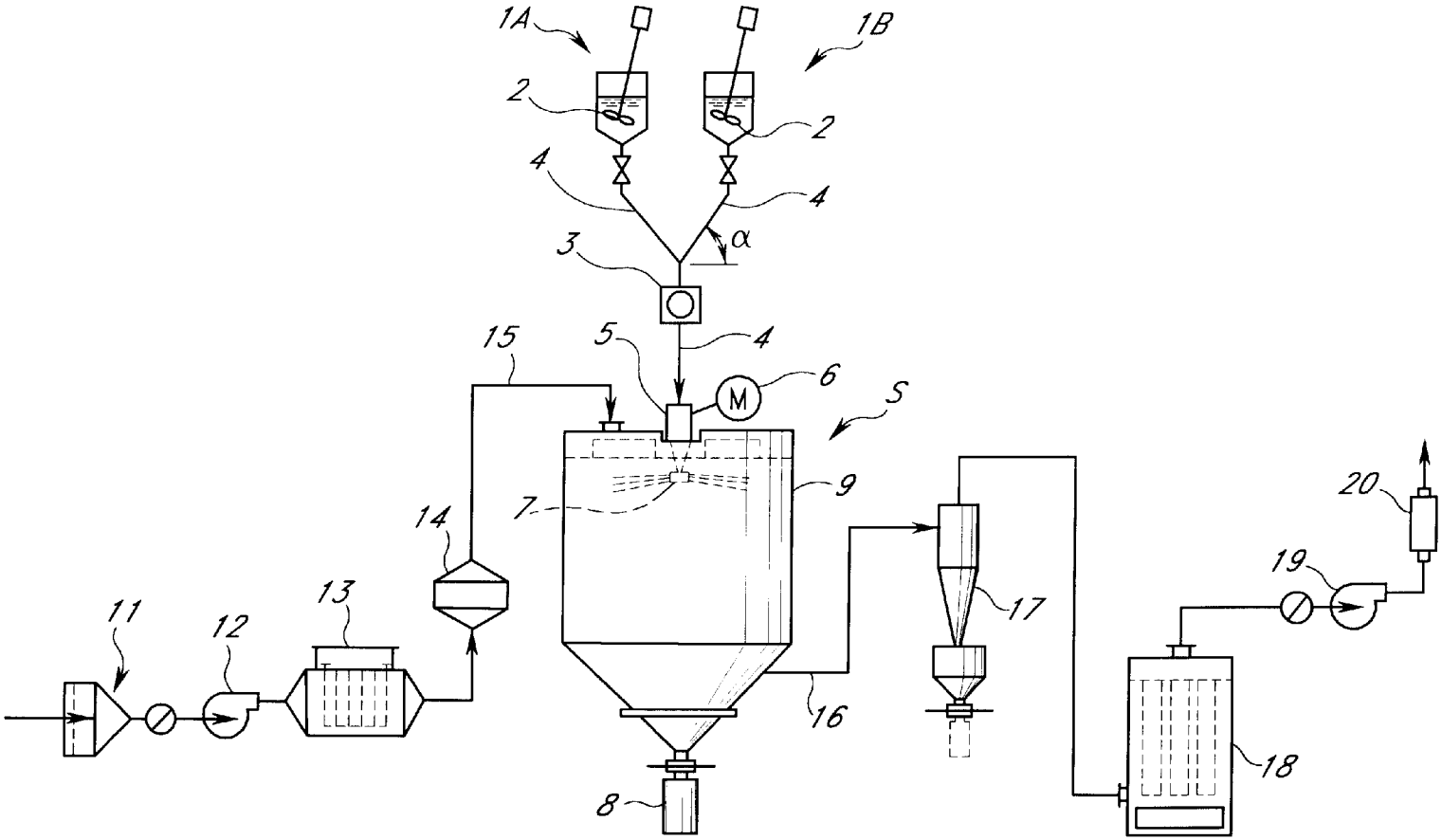
FIG. 1 is a model view showing an apparatus for producing a compound for a rare earth metal resin-bonded magnet according to the present invention.

The magnetic alloy powder to be used in the present invention may be any magnetic alloy containing a rare earth element, preferably powder of an R—Fe—B alloy, an R—Co alloy, or an R—Fe—N alloy. Such an alloy powder may be any of known R—Fe—B alloys, R—Co alloys and R—Fe—N alloys obtained by powdering an alloy having a predetermined composition or by powdering and then mixing alloys having different compositions into a mixture having a predetermined composition. Also, these powders may be obtained by a known technique such as alloy melting-crushing, melting and super rapid quenching, reduction diffusion process, HDDR(hydrogenation Decomposition Desorption Recombination) process, or atomizing process.

The binder resin to be used in the present invention may be any of known thermoplastic resins. The reaction-curing resin may be a resin generally known as a thermoset resin. Specifically, the reaction-curing resin may be a resin such as an unsaturated polyester resin or a diallyl phthalate resin that contains a vinyl bond to cure by radical polymerization, a resin such as an epoxy resin that cures by a ring-opening polymerization, a resin such as a polyurethane resin that cures by polyaddition reaction, or a resin such as a phenolic resin that cures by addition reaction. Particularly, it is preferable to use a material that forms compound granules having a good fluidity without fusion of constituent particles even by heating in drying before cross-linking curing.

The reaction-curing resin material is generally a two-component type resin. Namely, the resin that polymerizes by radical polymerization is a combination of a radical polymerization initiator and a reactive resin material; the polyurethane resin is a combination of a polyisocyanate component and a component containing an active hydrogen group; the phenolic resin is a combination of a component containing a phenol group and a formaldehyde-generating component such as hexamethylenetetramine.

The combination of these resin components is preferably such that it is comparatively stable at a temperature from room temperature to the drying temperature of the organic solvent in the spray dryer, but reacts rapidly to cure by heating after the compound for the resin-bonded magnet is molded.

A resin that polymerizes by isolating a low molecular compound such as water or a resin that uses a strong acidic substance as a curing agent or a catalyst is not preferable as the above-mentioned thermoset resin, because it tends to corrode the magnetic alloy powder. Also, the reaction-curing resin material exemplified above is generally a multi-component type resin with a main agent containing a base polymer as a major component and a catalyst or a curing agent that reacts with a reactive functional group owned by molecules constituting the resin. These components are mixed at the time of use and optionally heated to promote the reaction for curing, thereby completing the molded product.

A suitable binder resin for the resin-bonded magnet of the present invention is an epoxy resin. Examples of the epoxy resins that form a cured product having a high strength include novolak-type epoxy resins and bisphenol-type epoxy resins, both of which are usable. The curing agent to be used may be an amine compound or an acid anhydride. Considering the influence on the magnetic alloy, it is more preferable to use an amine curing resin.

The mixing ratio of the epoxy resin and the curing agent is preferably about 40/1 to 4/1. As a preferable embodiment, a reaction catalyst such as a tertiary amino compound or an imidazole compound may be used in accordance with the needs. These catalysts are used by being added to an amine compound or the like which is preferably a curing agent component.

The above-mentioned reaction-curing resin has a comparatively low molecular weight at the stage as a material because its molecular weight grows larger by polymerization reaction. Therefore, the viscosity of the slurry is low and is disadvantageous for inhibiting deposition of the magnetic alloy powder. In order to prevent this, a polymer compound may be added in a small amount to lower the deposition speed of the magnetic alloy powder in the slurry as a preferable embodiment.

The organic solvent to be used in the present invention may be any solvent that dissolves a binder resin material well and, when sprayed by a spray dryer, evaporates rapidly by a hot air of less than about 100° C. to form a compound in a dry state. Specific examples of the organic solvents include ketones such as acetone and methyl ethyl ketone (MEK), ethers such as tetrahydrofuran, dioxane, diethyl ether, and diisobutyl ether, aromatic compounds such as toluene, xylene (o-, m-, p-isomer, or a mixture thereof), and ethylbenzene, esters such as ethyl acetate, propyl acetate, and butyl acetate, aliphatic hydrocarbons such as hexane, pentane, and octane, alicyclic hydrocarbons such as cyclohexane, tetralin, and decalin, halogenated hydrocarbons such as dichloroethane, cellosolve compounds such as methyl cellosolve acetate, and alcohols such as methanol, ethanol, propanol, and methyl cellosolve. These organic solvents are selected by considering the compatibility with the binder resin to be used, the influence on the curing reaction, and the like.

It is a suitable embodiment to mix plural kinds of the above organic solvents for use. Especially, as mentioned above, it is preferable to use a solvent containing a good solvent and a poor solvent of the reaction-curing resin. The reason for this is not clear. However, it is presumed that, if only a good solvent used, the reaction-curing resin molecules exist floating in the solvent, whereas if a poor solvent is used in combination, the solubility of the reaction-curing resin decreases to form a state in which the reaction-curing resin molecules cover the magnetic alloy surface. As a result, the content of the organic component in the compound seems to become high thereby to improve the fluidity of the compound and, at the same time, to improve the mechanical strength of the press-molded product containing the compound.

Representative examples of the good solvents of the reaction-curing resin include ketones such as acetone, methyl ethyl ketone (MEK), ethers such as tetrahydrofuran, and esters such as ethyl acetate, propyl acetate, and butyl acetate. Representative examples of the poor solvents of the reaction-curing resin include aromatic hydrocarbons such as toluene, xylene (o-, m-, p-isomer, or a mixture thereof), and ethylbenzene, aliphatic hydrocarbons such as hexane, pentane, and octane, and alicyclic hydrocarbons such as cyclohexane, tetralin, and decalin.

Here, the solubility of the reaction-curing resin varies depending on the organic solvents. An organic solvent that induces a solubility behavior of the reaction-curing resin similar to that of the mixed solvent of the present invention can be used singly as a suitable organic solvent.

In producing the compound, it is a preferable embodiment to add a polyhydric alcohol such as glycerin, a wax, stearic acid, a metal stearate (for example, zinc stearate, calcium stearate, or magnesium stearate), one or more kinds of a dispersing agent/lubricant such as phthalates, and an antifoaming agent such as n-octanol in addition to the above-mentioned materials. Use of an additive such as a dispersing agent, a lubricant, and an antifoaming agent improves the dispersing property of the magnetic alloy powder in the slurry, whereby the homogeneity and the powdered state in the spray dryer are improved, and a stable production step is provided because no foams are generated.

Hereafter, an example of the apparatus to be used for the production process of the present invention will be explained with reference to the attached drawings.

Figure 3:
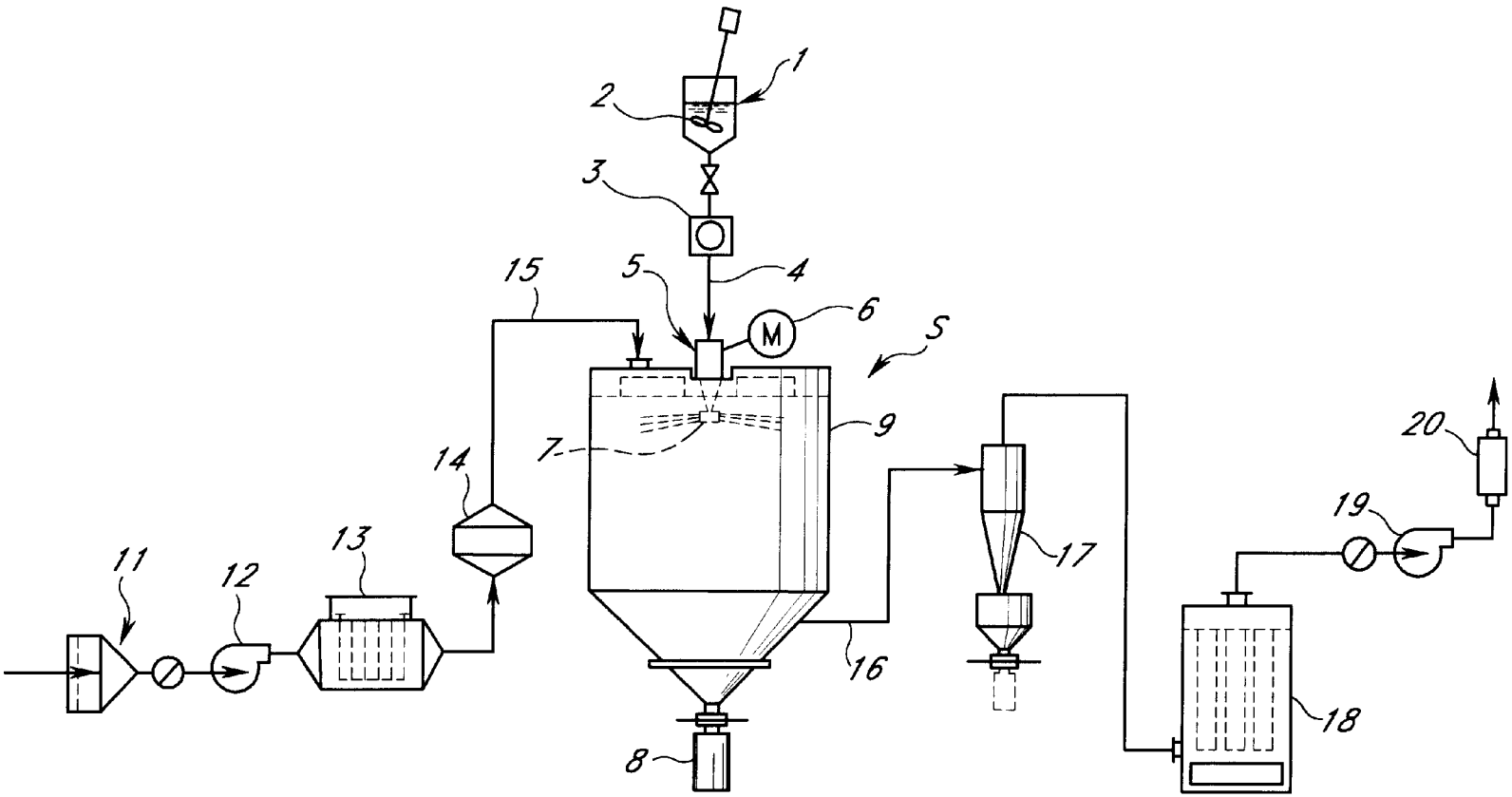
FIG. 3 is a model view showing another apparatus of this invention.

The apparatus of the present invention is constructed mainly with a slurry preparation apparatus, a spray dryer, a hot air generating apparatus for sending a hot air to the spray dryer, and a dust-removing/gas-exhausting apparatus. Materials containing a magnetic alloy powder of a rare earth metal alloy, a reaction-curing resin material, and an organic solvent are uniformly mixed and stirred in a slurry preparation apparatus 1 equipped with a stirrer 2 to be sent to a spray dryer S via a fixed-rate supplying pump 3 through a slurry supplying pipe 4. (FIG. 3) In the example shown in FIG. 1, two slurry preparation apparatus 1A and 1B are provided whereby the slurry is prepared in each slurry preparation apparatus by a batch process and the prepared slurries are alternately supplied to the spray dryer S, so that the compound can be produced continuously.

Both of the slurry preparation apparatus 1A and 1B are disposed above the spray dryer S, whereby the slurry can be supplied to an atomizer 5 of the spray dryer S via the slurry supplying pipe 4 and the fixed-rate supplying pump 3. The slurries can be supplied continuously by preparing a slurry in one slurry preparation apparatus while supplying another slurry from the other slurry preparation apparatus. It is also a preferable embodiment to dispose a pipe for supplying a cleaning solvent. The inclination angle of the slurry supplying pipe is shown by $\alpha$ in FIG. 1. If the slurry supplying pipe is curved, the smallest inclination is preferably at least 45°.

The spray dryer S includes an atomizer (atomizing apparatus) 5 made of a disk 7 driven by a motor 6 above a vessel 9, a hot air supplying pipe 15, a gas-exhausting pipe 16, and an outlet 8 for discharging a compound containing a magnetic alloy powder of a rare earth metal alloy and a reaction-curing resin material. The slurry sent from the slurry supplying pipe is supplied onto the rotating disk 7 to be atomized horizontally and dried instantly by a hot air.

The rotating speed of the disk is not specifically limited as long as the atomized state of the slurry is good. Generally, the rotating speed is about 3,000 to 15,000 rpm. The obtained compound is then mixed with a metal stearate lubricant such as calcium stearate and subjected to molding.

The spray dryer S is suitably selected in accordance with the production capability. The vessel 9 preferably has a diameter of at least about 1500 mm. If the vessel 9 is too small, the slurry atomized by the atomizer will reach the vessel wall without being sufficiently dried.

Several types of spray dryers provided with an atomizer are available and may be used without any particular limitation if the atomized and dried state of the slurry is good. Considering the fact that it is necessary to atomize a slurry of a magnetic alloy powder of a rare earth metal alloy having a particle size of 30 to 250 $\mu$m before deposition of the magnetic alloy powder, it is particularly preferable to use a spray dryer of rotary disk type having a circular disk that rotates in a horizontal direction as mentioned above.

Known atomizers of rotary disk type may be classified into vane type, kestner type, pin type, and others in accordance with the shape of the ejection outlet of the slurry, and any of these may be used without a particular limitation.

The atomizer to be used in the present invention may be a known one. Rotary disc of atomizer is composed of materials such as stainless steel or ceramics. A typical rotary disk to be used has a diameter of about 50 to 200 mm. In a preferable embodiment, a rod having one of a variety of shapes is disposed to stand on the disk for increasing the drying efficiency.

The hot air is generated by sucking a drying gas through a filter 11 by a gas supplying fan 12 and heating the gas by a heat exchanger 13 such as an electric heater or a steam heater. The generated hot air is then subjected to removal of dusts by a hot air filter 14 and supplied to the spray dryer through a hot air supplying pipe 15.

The exhaust gas after drying contains fine powder consisting of resin alone or originally mingled fine powder of an alloy magnetic material. After being discharged from the exhaust pipe 16, the exhaust gas is subjected to sufficient removal of dusts by a cyclone-type dust remover 17 and a bag filter 18 located in the rear thereof, and is advantageously discharged via a silencer 20. It is also preferable to dispose an apparatus for collecting and removing the organic solvent for circulation.

The drying gas is preferably an inert gas, especially nitrogen or argon, for preventing oxidation of the magnetic alloy.

Figure 2:
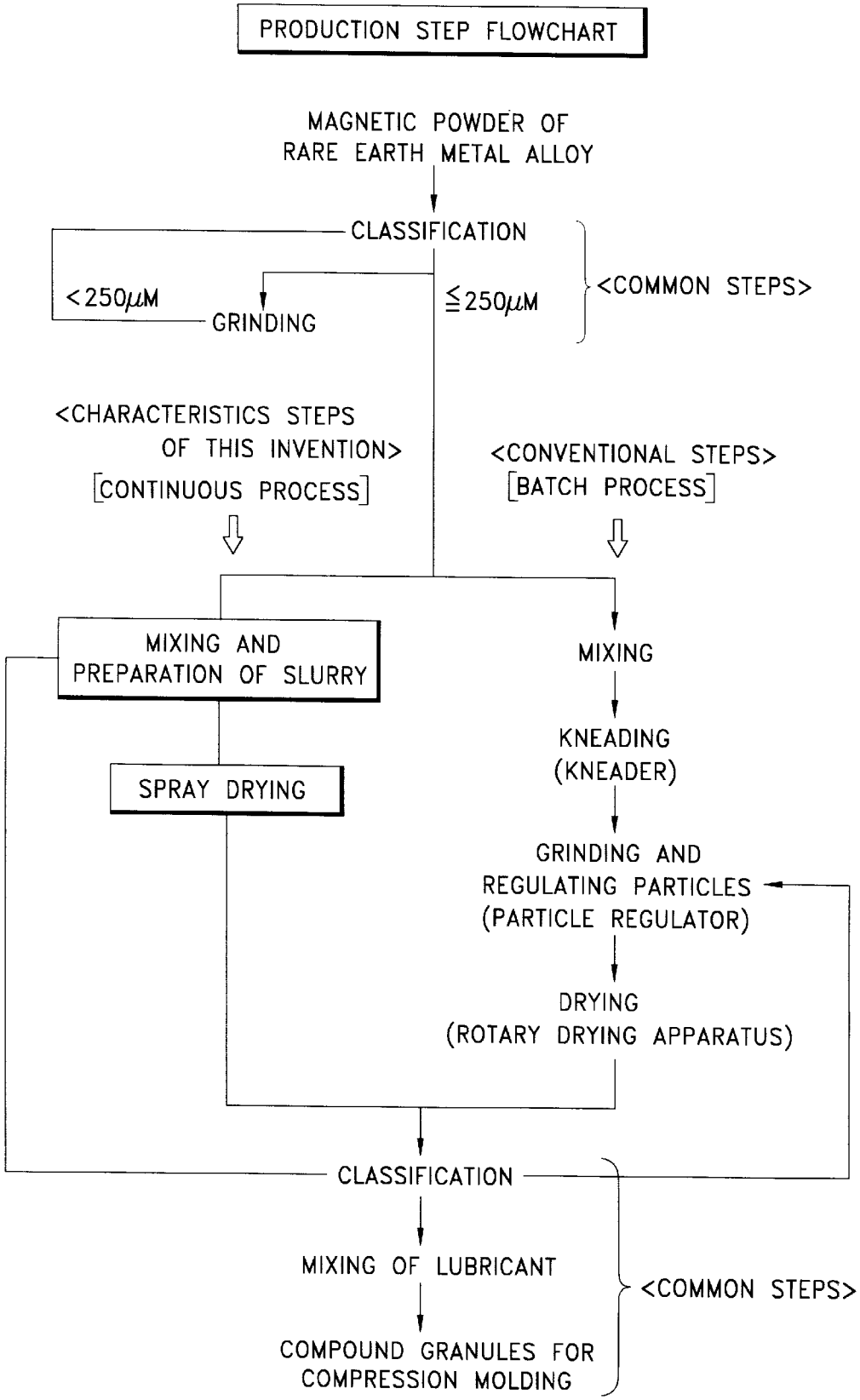
FIG. 2 is a step flowchart showing steps for producing a compound for a rare earth metal resin-bonded magnet of the present invention as compared with a conventional process.

An outline of the flowchart of the steps for the present invention is shown in FIG. 2 by comparing it with a conventional kneading process. In the conventional process, it is necessary to perform kneading by means of a kneader or the like, necessitating a batch process. On the other hand, it will be understood that the steps of the present invention are small in number and allow continuous production. Here, the classification of the magnetic alloy powder as a material and the steps after the classification of the compound are common to both the present invention and the conventional process.

EMBODIMENTS

The embodiments of the present invention will be explained with reference to the following examples.

EXAMPLES 1 to 6

The particle size of the rare earth metal alloy powder was adjusted to be 30 to 200 $\mu$m before use. A bisphenol epoxy resin was used as the reaction-curing resin.

For the organic solvent, methyl ethyl ketone (MEK) was used as the good solvent, and toluene and xylene were used as the poor solvent. The solvent composition is shown in the upper section of Table 1.

To the rare earth metal alloy powder, 3.0 wt % of the epoxy resin was mixed, and the organic solvent was mixed so that the slurry concentration would be 20 vol %, thereby to prepare a slurry containing the magnetic alloy powder of the rare earth metal alloy and the reaction-curing resin. The slurry was supplied to a spray dryer for spray drying to prepare a compound.

COMPARATIVE EXAMPLE 1

A compound was prepared in the same manner as in Example 1 except that MEK alone was used as the organic solvent.

Evaluation (1) Carbon Content in the Compound

The amount of organic substances such as reaction-curing resin contained in the compound and the resin adhesion degree on the magnetic alloy surface were evaluated using the carbon content as measured by EPMA. The carbon content by EPMA was measured using the carbon distribution at magnifications of 80 times and 400 times.

The results are shown in the second row of Table 1. From this result, it will be understood that a mixed solvent system gives a higher carbon content than the case in which MEK is used alone as an organic solvent.

(2) Fluidity of the Compound

The fluidity of the compound was evaluated by measuring the fluidity. The fluidity was determined as a period of time (sec/50g) in which 50 g of a sample flows down from a funnel having an orifice of 2.6 mm diameter. The measurement was carried out three times for each sample, and the results of measurement are shown in the third row of Table 1.

From this result, it will be understood that a mixed solvent system gives a larger fluidity than the case in which MEK is used alone as an organic solvent, whereby a compound having a fluidity suitable for press-molding is obtained.

(3) Mechanical Strength of the Press-molded Product

The obtained compound was press-molded with a pressure of 8 Ton/cm$^2$ to prepare three samples of prismatic molded products having a size of 10.1 mm×3.3 mm×40.3 mm. Each sample was supported with a distance between the supporting points being 25 mm, and a load was applied to a central portion with the lateral side (3.3 mm) being a height direction, to measure the flexural strength (fracture resistance strength).

The result of measurement of the fracture resistance strength are shown in the fourth row of Table 1 together with the above results (1) and (2). From this result, it will be clearly understood that, with a mixed solvent system, it is possible to obtain a compound that gives a molded product having a larger strength when press-molded, than in the case in which MEK is used alone as an organic solvent.

As shown above, it will be understood that the compound for a rare earth metal resin-bonded magnet obtained by using a mixed solvent system has a large content of reaction-curing resin, whereby the fluidity of the compound is excellent and a press-molded product having a large mechanical strength can be obtained.

EXAMPLES 7 to 13 AND COMPARATIVE EXAMPLES 2 to 6

The same rare earth metal alloy powder and the same reaction-curing resin as in Examples 1 to 6 were used. For the organic solvent, methyl ethyl ketone (MEK) was used as a good solvent, and xylene was used as a poor solvent in the ratio of toluene/xylene=50/50.

In Examples 7–9 and Comparative Examples 2 and 3, the slurry concentration was fixed to be 20 vol %, and the mixing ratio of epoxy resin (reaction-curing resin) to the rare earth metal alloy powder was varied within the range of 0.5 to 7 wt % to prepare a slurry.

In Examples 10–13 and Comparative Examples 4 and 5, the mixing ratio of epoxy resin (reaction-curing resin) to the rare earth metal alloy powder was set to be 3 wt %, and the slurry concentration was varied within the range of 5 to 60 vol % to prepare a slurry.

Each slurry was supplied to the spray dryer for spray drying to prepare a compound. Then, the supplying property of the slurry, the drying property of the collected material compound, and the resin adhesion degree on the rare earth metal alloy powder surface were evaluated.

Compound of Example 7–9 and comparative example 2, 3 were molded to magnets, and the magnetic properties of the magnets were measured The results are shown in Table 2.

TABLE 1

| | | Example 1 | | | Example 2 | | | Example 3 | | | Example 4 | | |
|---|---|---|---|---|---|---|---|---|---|---|---|---|---|
| Solvent composition | MEK | 70 | | | 50 | | | 30 | | | 70 | | |
| | toluene | 30 | | | 50 | | | 70 | | | — | | |
| | xylene | — | | | — | | | — | | | 30 | | |
| Carbon content (%) | | 0.63 | | | 0.77 | | | 1.61 | | | 0.71 | | |
| | | (115) | | | (140) | | | (293) | | | (129) | | |
| Compound fluidity (sec/50 g) | | 27.9 | | Mean | 30.4 | | Mean | 30.3 | | Mean | 26.9 | | Mean |
| | | 28.1 | | 28.1 | 30.8 | | 30.6 | 30.7 | | 30.5 | 27.1 | | 27.1 |
| | | 28.3 | | | 30.5 | | | 30.5 | | | 27.2 | | |
| Fracture resistance strength of molded product (kgf/mm$^2$) | | 2.98 | 2.79 | 2.71 | 4.06 | 4.06 | 4.09 | 8.12 | 8.43 | 8.17 | 3.38 | 3.37 | 3.55 |

| | | Example 5 | | | Example 6 | | | Comparative Example 1 | | |
|---|---|---|---|---|---|---|---|---|---|---|
| Solvent composition | MEK | 50 | | | 30 | | | 100 | | |
| | toluene | — | | | — | | | — | | |
| | xylene | 50 | | | 70 | | | — | | |
| Carbon content (%) | | 0.96 | | | 1.70 | | | 0.55 | | |
| | | (175) | | | (309) | | | (100) | | |
| Compound fluidity (sec/50 g) | | 30.0 | | Mean | 29.0 | | Mean | 32.4 | | Mean |
| | | 30.4 | | 30.3 | 29.1 | | 29.1 | 32.4 | | 32.4 |
| | | 30.6 | | | 29.0 | | | 32.4 | | |
| Fracture resistance strength of molded product (kgf/mm$^2$) | | 4.59 | 5.19 | 5.22 | 8.63 | 8.59 | 8.65 | 1.62 | 2.43 | 2.15 |

Notes

The numerals in parentheses for the carbon content are indices calculated with the carbon content of Comparative Example being assumed to be 100.

TABLE 2

| | Loading of resin (wt %) | Slurry concentration (vol %) | Slurry supplying property | Drying property of compound | Resin adhesion degree on magnetic alloy surface | Magnetic property Br (T) | $H_{CB}$ (kA/m) | (BH)max (kJ/m$^3$) | $H_{CJ}$ (kA/m) | Overall evaluation |
|---|---|---|---|---|---|---|---|---|---|---|
| Example 7 | 1 | 20 | ◎ | ◎ | ○ | 0.680 | 447.6 | 77.0 | 775.6 | ○ |
| Example 8 | 3 | | ◎ | ◎ | ◎ | 0.672 | 447.2 | 76.0 | 778.8 | ◎ |
| Example 9 | 5 | | ◎ | ◎ | ○ | 0.644 | 444.0 | 74.6 | 782.1 | ○ |
| Comparative Example 2 | 0.5 | | ◎ | ◎ | x | 0.682 | 447.3 | 77.2 | 774.8 | x |
| Comparative Example 3 | 7 | | ◎ | ◎ | Δ | 0.614 | 417.0 | 64.6 | 783.1 | x |
| Example 10 | 3 | 15 | ○ | ○ | ○ | | | | | ○ |
| Example 11 | | 30 | ◎ | ◎ | ◎ | | | | | ◎ |
| Example 12 | | 40 | ○ | ◎ | ○ | | | | | ○ |
| Example 13 | | 50 | Δ | ○ | Δ | | | | | Δ |
| Comparative Example 4 | | 5 | Non-uniform concentration | x | x | | | | | x |
| Comparative Example 5 | | 60 | Clogging occurred | Evaluation impossible | Evaluation impossible | | | | | x |

◎ Excellent
○ Fair
Δ Good
x Poor

From the results shown in Table 2, it will be understood that the mixing ratio of the resin binder to the magnetic alloy powder is preferably 1 to 5 wt %, and the slurry concentration is preferably 15 to 50 vol %.

What is claimed is:

1. A process for producing a compound to be formed into a rare earth metal resin-bonded magnet, comprising:

a slurry preparation step of mixing materials containing a magnetic alloy powder of a rare earth metal alloy having a particle size of 30–250 μm, a resin binder, and an organic solvent into a slurry wherein a weight ratio of the resin binder to the magnetic alloy powder in the slurry is 1/100 to 1/20; and a drying step of spraying and drying said slurry by means of a spray dryer apparatus to produce a compound having a particle size of less than 250 μm and containing the magnetic alloy powder of the rare earth metal and the resin binder.

2. A process for producing a compound for a rare earth metal resin-bonded magnet according to claim 1, wherein said resin binder is a reaction-curing resin binder.

3. A process for producing a compound for a rare earth metal resin-bonded magnet according to claim 1, wherein said slurry has a magnetic alloy powder concentration of 15 to 50 vol %.

4. A process for producing a compound for a rare earth metal resin-bounded magnet comprising:

a slurry preparation step of mixing materials containing a magnetic alloy powder of a rare earth metal alloy, a resin binder, and an organic solvent into a slurry; and a drying step of spraying and drying said slurry by means of a spray dryer apparatus to produce a compound containing the magnetic alloy powder of the rare earth metal and the resin binder, wherein said organic solvent contains a good solvent and a poor solvent of said resin binder.

5. A process for producing a compound for a rare earth metal resin-bonded magnet comprising:

a slurry preparation step of mixing materials containing a magnetic alloy powder of a rare earth metal alloy, a resin binder, and an organic solvent into a slurry, wherein said resin binder is a reaction-curing resin binder; and a drying step of spraying and drying said slurry by means of a spray dryer apparatus to produce a compound containing the magnetic alloy powder of the rare earth metal and the resin binder, wherein said organic solvent contains a good solvent and a poor solvent of said resin binder.

6. A process for producing a compound for a rare earth metal resin-bonded magnet according to claim 5, wherein said good solvent is one or more kinds of ketone solvents and said poor solvent is one more kinds of aromatic hydrocarbons or alicyclic hydrocarbons.

7. A process for producing a compound for a rare earth metal resin-bonded magnet according to claim 4, wherein a ratio of said good solvent, and said poor solvent is 70/30 to 10/90 in terms of good solvent/poor solvent weight ratio.

8. A process for producing a compound for a rare earth metal resin-bonded magnet according to claim 5, wherein a ratio of said good solvent and said poor solvent is 70/30 to 10/90 in terms of good solvent/poor solvent weight ratio.

9. A process for producing a compound for a rare earth metal resin-bounded magnet according to claim 1, wherein said resin binder is a reaction-curing resin binder; said organic solvent contains a good solvent and a poor solvent of said reaction-curing resin; said good solvent is one or more kinds of ketone solvents; said poor solvent is one or more kinds of aromatic hydrocarbons or alicyclic hydrocrbonds; a ratio of said good solvent and said poor solvent is 70/30 to 10/90 in terms of good solvent/poor solvent weight ratio; and said slurry has a magnetic alloy powder concentration of 15 to 50 vol %.

10. A process for producing a compound for a rare earth metal resin-bonded magnet according to claim 9, wherein said reaction-curing resin is an epoxy resin.

* * * * *